US008042312B2

(12) United States Patent
Kang et al.

(10) Patent No.: US 8,042,312 B2
(45) Date of Patent: Oct. 25, 2011

(54) THREE-DIMENSIONAL CELLULAR LIGHT STRUCTURES DIRECTLY WOVEN BY CONTINUOUS WIRES AND THE MANUFACTURING METHOD OF THE SAME

(75) Inventors: Ki Ju Kang, Chonnam (KR); Yong Hyun Lee, Kwangju (KR)

(73) Assignee: Industry Foundation of Chonnam National University (KR)

( * ) Notice: Subject to any disclaimer, the term of this patent is extended or adjusted under 35 U.S.C. 154(b) by 770 days.

(21) Appl. No.: 10/578,421

(22) PCT Filed: Nov. 5, 2004

(86) PCT No.: PCT/KR2004/002864

§ 371 (c)(1),
(2), (4) Date: May 5, 2006

(87) PCT Pub. No.: WO2005/044483

PCT Pub. Date: May 19, 2005

(65) Prior Publication Data

US 2007/0095012 A1 May 3, 2007

(30) Foreign Application Priority Data

Nov. 7, 2003 (KR) ..... 10-2003-0078507

(51) Int. Cl.
*E04C 5/04* (2006.01)

(52) U.S. Cl. ..... 52/664; 52/648.1

(58) Field of Classification Search ..... 52/653.2, 52/649.1, 648.1, 651.06, 651.09, 653.1, 664, 52/650.2, 652.1

See application file for complete search history.

(56) References Cited

U.S. PATENT DOCUMENTS 1,444,491 A * 2/1923 Baldwin ..... 273/350
2,677,955 A * 5/1954 Constantinesco ..... 428/221

(Continued)

FOREIGN PATENT DOCUMENTS

DE 195 27 618 2/1997

(Continued)

OTHER PUBLICATIONS

S. Hyun, A.M. Karlsson , S. Torquato, A.G. Evans, 2003. Int J. of Solids and Structures, vol. 40, pp. 6989-6998.

(Continued)

*Primary Examiner* — Jeanette E Chapman
*Assistant Examiner* — Daniel Kenny
(74) *Attorney, Agent, or Firm* — Ostrolenk Faber LLP

(57) ABSTRACT

Disclosed herein is a three-dimensional cellular light structure formed of continuous wire groups. In the cellular light structure, six orientational-wire groups are intercrossed each other at 60 degrees or 120 degrees of angles in a three-dimensional space to thereby construct the structure similar to the ideal Octet or Kagome truss and having a good mechanical property such as strength, rigidity or the like. A method of mass-producing the structure in a cost-effective manner is also disclosed. The three-dimensional cellular light structure has a similar form to the ideal Octet or Kagome truss. When required, the intersection points of the wires are bonded by means of welding, brazing, soldering, or a liquid- or spray-form adhesive to provide a structural material having a light weight and a good mechanical strength and rigidity. It can be made into a fiber-reinforced type composite material by filling part of or entire internal empty space of the structure.

4 Claims, 15 Drawing Sheets

U.S. PATENT DOCUMENTS

| | | | | | |
|---|---|---|---|---|---|
| 2,986,241 | A | | 5/1961 | Fuller | 189/34 |
| 3,139,959 | A | | 7/1964 | Kraft | |
| 3,169,611 | A | * | 2/1965 | Snelson | 52/648.1 |
| 3,221,464 | A | | 12/1965 | Miller | |
| 4,271,628 | A | * | 6/1981 | Barlow | 446/126 |
| 4,539,786 | A | | 9/1985 | Nelson | 52/645 |
| 4,603,519 | A | * | 8/1986 | Lew et al. | 52/81.2 |
| 4,667,451 | A | | 5/1987 | Onoda | 52/646 |
| 4,711,057 | A | * | 12/1987 | Lew et al. | 52/81.2 |
| 4,722,162 | A | * | 2/1988 | Wilensky | 52/652.1 |
| 4,723,382 | A | * | 2/1988 | Lalvani | 52/81.1 |
| 4,735,026 | A | * | 4/1988 | Forsythe | 52/404.3 |
| 4,803,824 | A | * | 2/1989 | Coppa | 52/652.1 |
| 5,040,966 | A | | 8/1991 | Weisse | |
| 5,197,254 | A | * | 3/1993 | Smith | 52/653.1 |
| 5,265,395 | A | | 11/1993 | Lalvani | 52/648.1 |
| 5,398,470 | A | * | 3/1995 | Ritter et al. | 52/309.11 |
| 5,430,989 | A | * | 7/1995 | Jones | 52/655.1 |
| RE35,085 | E | * | 11/1995 | Sanderson | 52/655.1 |
| 5,473,852 | A | * | 12/1995 | Lindsey | 52/648.1 |
| 5,505,035 | A | | 4/1996 | Lalvani | 52/648.1 |
| 6,076,324 | A | * | 6/2000 | Daily et al. | 52/648.1 |
| 6,170,560 | B1 | | 1/2001 | Daily et al. | |
| 6,739,937 | B2 | * | 5/2004 | Snelson | 446/107 |
| 6,868,640 | B2 | * | 3/2005 | Barber | 52/81.1 |
| 6,993,879 | B1 | * | 2/2006 | Cantley | 52/652.1 |
| 7,318,303 | B1 | * | 1/2008 | Kling | 52/648.1 |
| 7,384,097 | B2 | * | 6/2008 | Park et al. | 297/45 |
| 2001/0010140 | A1 | * | 8/2001 | Ritter et al. | 52/649.1 |
| 2002/0081936 | A1 | * | 6/2002 | Snelson | 446/111 |

FOREIGN PATENT DOCUMENTS

| | | |
|---|---|---|
| JP | 08-219379 | 8/1996 |

OTHER PUBLICATIONS

S. Chiras, D.R. Mumm, N. wicks, A.G. Evans, J.W. Hutchinson, K. Dharmasena, H.N.G. Wadley, S. Fichter, 2002, International Journal of Solids and Structures, vol. 39, pp. 4093-4115.

D.J. Sypeck and H.N. G. Wadley, 2002, Advanced Engineering Materials, vol. 4, pp. 759-764.

D.J. Sypeck and H.G.N. Wadley, 2001, J. Mater. Res., vol. 16, pp. 890-897.

International Search Report PCT/KR2004/002864 dated Feb. 22, 2005.

German Office Action dated Sep. 5, 2007.

* cited by examiner (side view)

(unit cell)

[Fig.6]
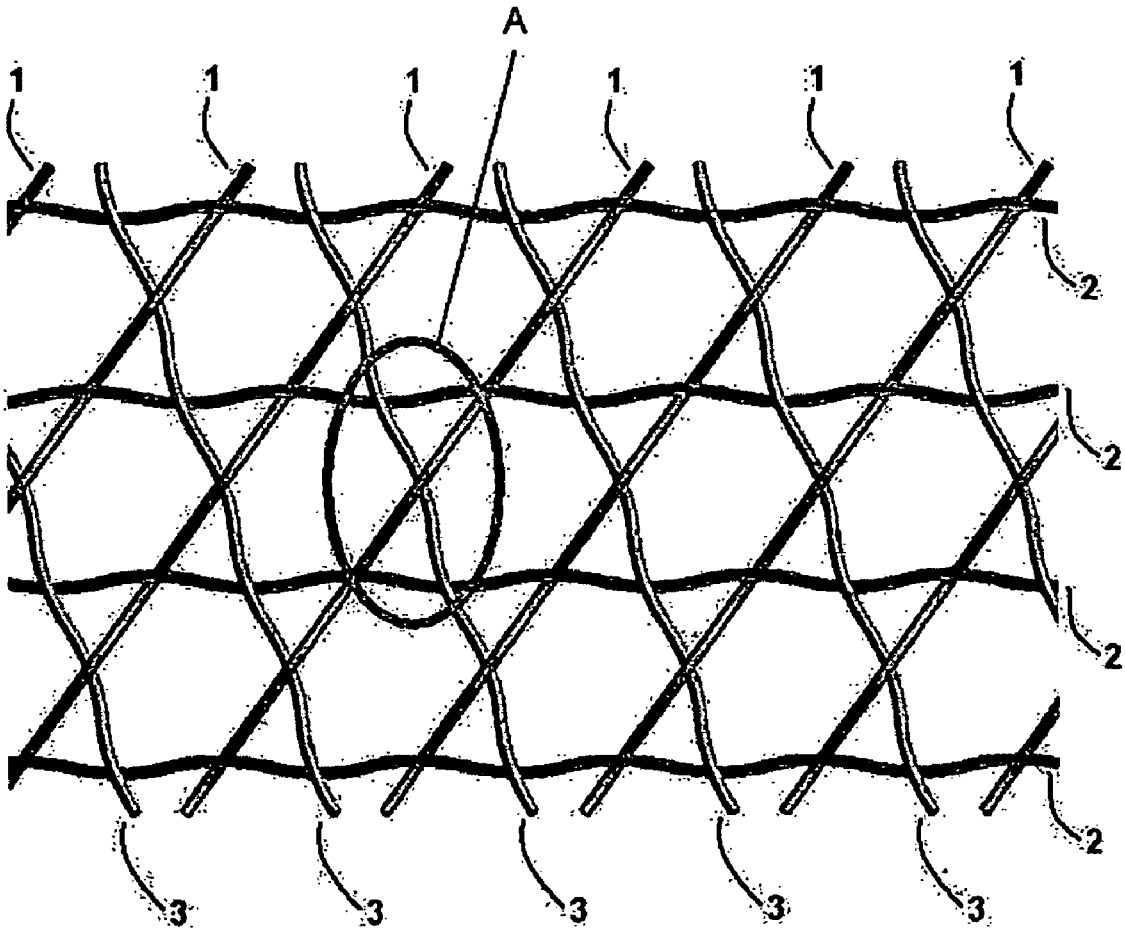

[Fig.7]
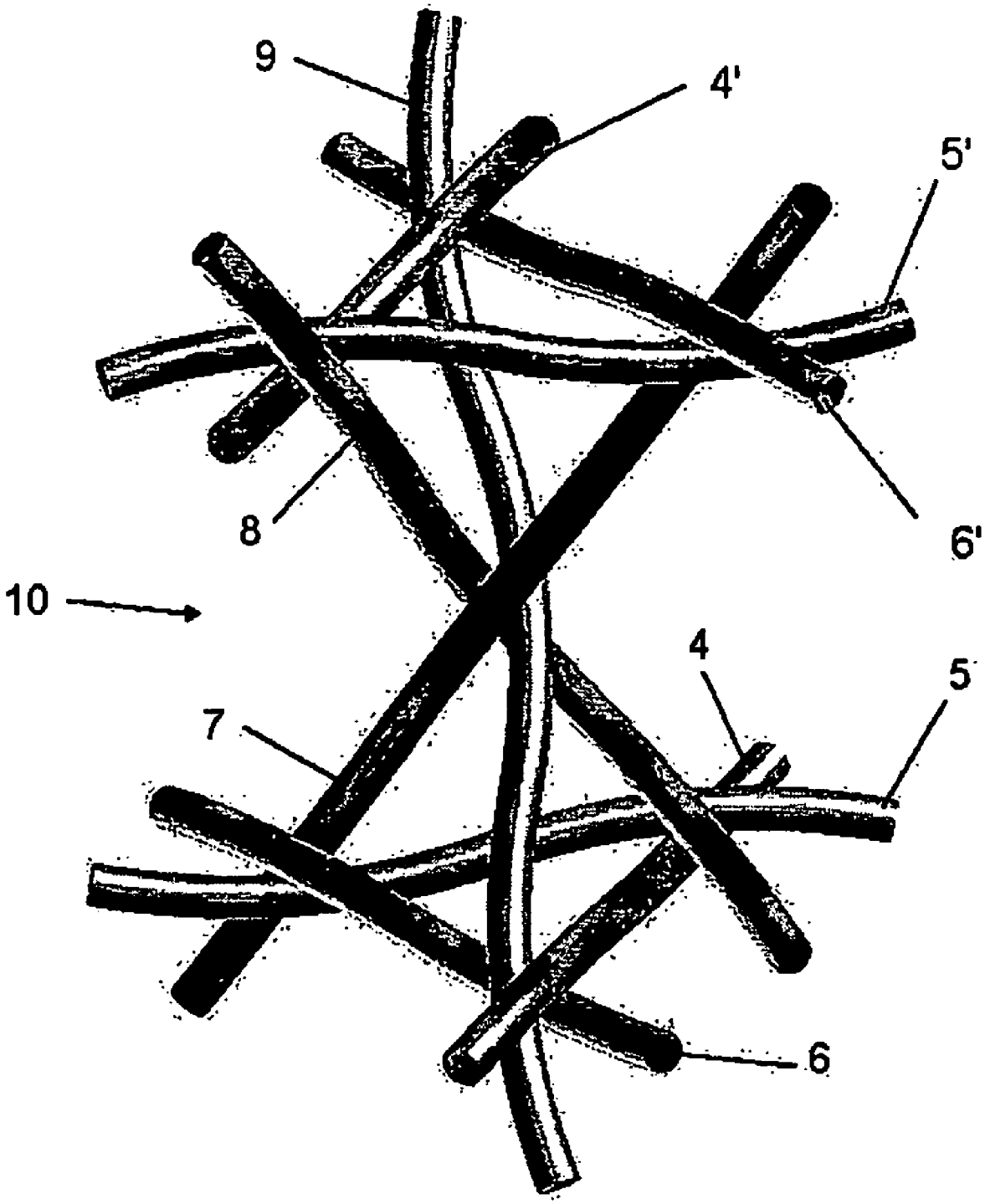

[Fig.8]
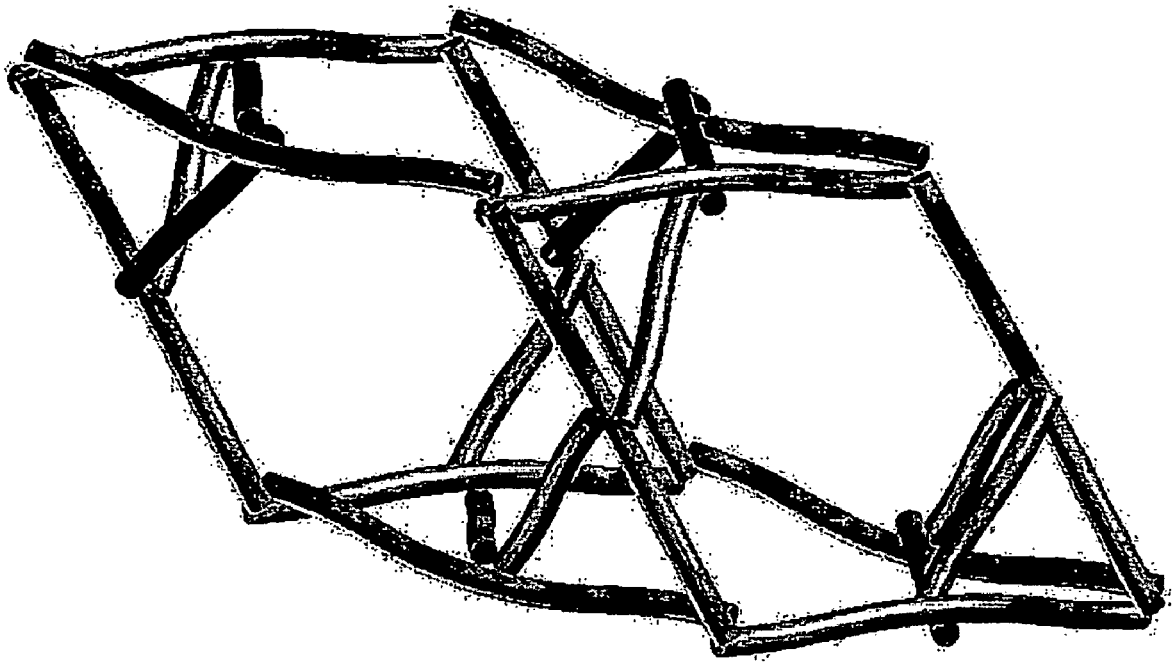

[Fig.15]
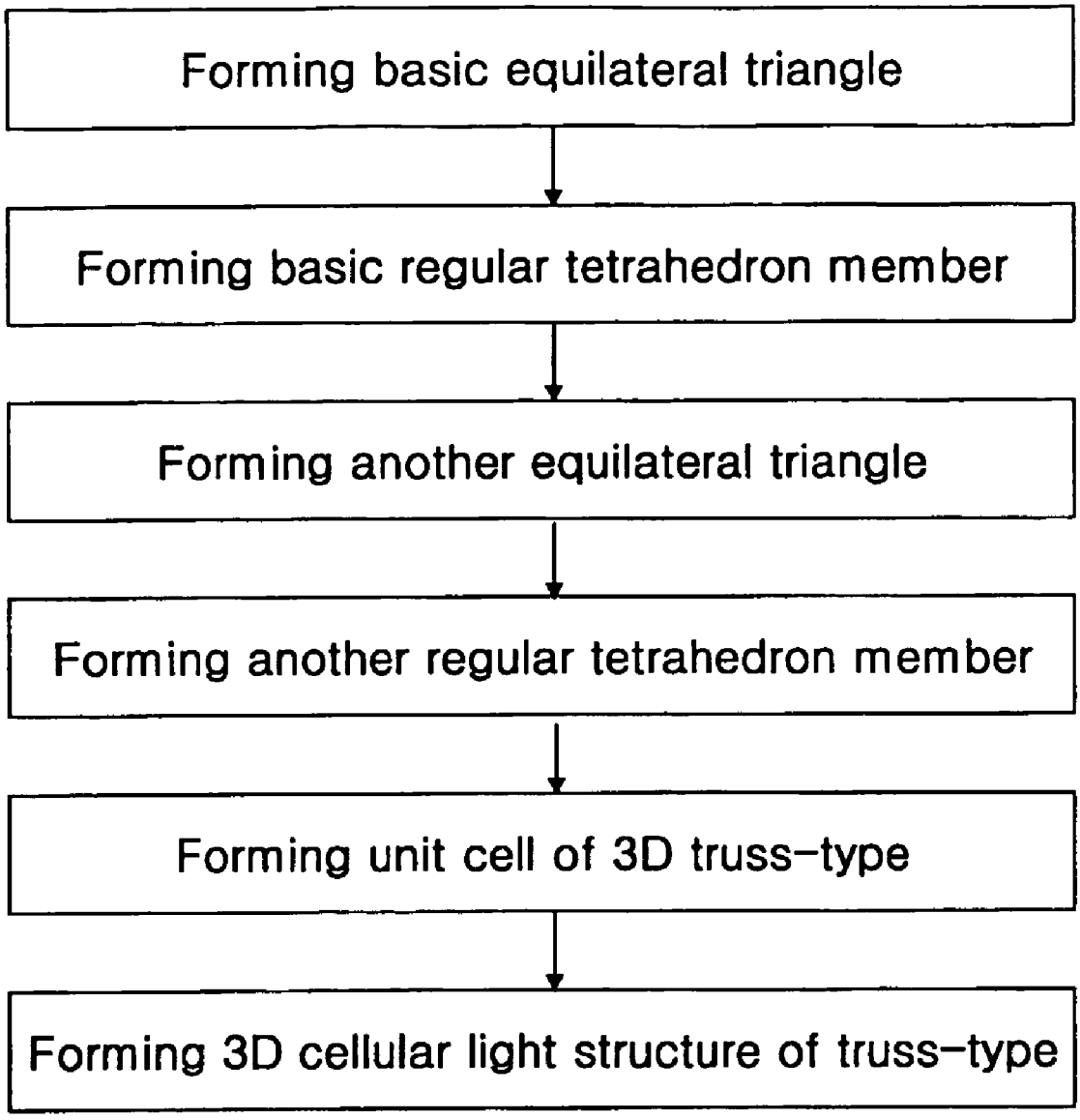

THREE-DIMENSIONAL CELLULAR LIGHT STRUCTURES DIRECTLY WOVEN BY CONTINUOUS WIRES AND THE MANUFACTURING METHOD OF THE SAME

CROSS REFERENCE TO RELATED APPLICATIONS

The present application is a 35 U.S.C. §371 national phase conversion of International Application No. PCT/KR2004/002864 filed Nov. 5, 2004 which claims priority from Korean patent application No. 10-2003-0078507 filed Nov. 7, 2003 incorporated herein by reference. The PCT International Application was published in the English language.

TECHNICAL FIELD

The present invention relates to a three-dimensional wire-woven cellular light structure formed of a group of continuous wires and a method of fabricating the same. In particular, the invention relates to such a cellular light structure, in which six orientational-wire groups are intercrossed with respect to each other at 60 degrees or 120 degrees angles in a three-dimensional space to thereby construct the structure similar to the ideal Octet or Kagome truss and having good mechanical properties such as strength, rigidity or the like. Also, the invention relates to the method of mass-producing the same in a cost-effective manner.

BACKGROUND ART

Conventionally, a metal foam has been known as a typical cellular light structure. This metal foam is manufactured by producing bubbles inside a metal of liquid or semi-solid state (Closed cell), or by casting the metal into a mold made of a foaming resin (Open cell). However, these metal foams have relatively inferior mechanical properties such as strength and rigidity. In addition, due to their high manufacturing cost, they have not been used widely in practice, except for a special purpose such as in airspace or aviation industries.

As a substitute material for the above mentioned metal foams, open cell-type light structures having periodic truss cells have been developed. This open cell-type light structure is designed so as to have an optimum strength and rigidity through precision mathematical and mechanical analysis, and therefore it has good mechanical properties. A typical truss structure is exemplified by the Octet truss where regular tetrahedrons and octahedrons are combined (See R. Buckminster Fuller, 1961, U.S. Pat. No. 2,986,241). Each element of the truss forms an equilateral triangle and thus it is advantageous in terms of strength and rigidity. Recently, as a modification of the Octet truss, the Kagome truss has been reported (See S. Hyun, A. M. Karlsson, S. Torquato, A. G. Evans, 2003. Int. J. of Solids and Structures, Vol. 40, pp. 6989-6998).

Referring to FIGS. 1*a* to 1*b*, the two-dimensional Octet truss 101 and the two-dimensional Kagome truss 102 are compared, that is, the unit cell 102*a* of the Kagome truss 102 has an equilateral triangle and a regular hexagon mixed in each face, dissimilar to the unit cell 101*a* of the Octet truss 101. FIGS. 2*a*-2*c* and 3*a*-3*c* show a single layer of the three-dimensional Octet truss 201 and the three-dimensional Kagome truss 202, respectively. Comparing the unit cell 201*a* of the three-dimensional Octet truss 201 with the unit cell 202*a* of the three-dimensional Kagome truss 202, one significant feature of the 3D Kagome truss 202 is that it has isotropic mechanical properties. Therefore, the structural materials or other materials based on the Kagome truss have a uniform mechanical and electrical property regardless of its orientation.

On the other hand, several processes have been used for manufacturing a cellular light structure of truss-type. First, a truss structure is formed of a resin and a metal is cast using the truss structure as a mold (See S. Chiras, D. R. Mumm, N. Wicks, A. G Evans, J. W. Hutchinson, K. Dharmasena, H. N. G. Wadley, S. Fichter, 2002, International Journal of Solids and Structures, Vol. 39, pp. 4093-4115). Second, a metallic net is formed by making periodic holes in a thin metal plate, a truss core is formed by crimping the metallic net, and face sheets are bent to the upper and lower portion thereof (See D. J. Sypeck and H. N. G. Wadley, 2002, Advanced Engineering Materials, Vol. 4, pp. 759-764). Here, in the case where a multi-layered structure having more than one layer is fabricated, another crimped-truss core is placed above the upper face sheet and another upper face sheet is positioned again above second core. In a third method, a wire-net is first woven using two orientational-wires perpendicular to each other, and then the wire-nets are laminated and bonded (See D. J. Sypeck and H. G. N. Wadley, 2001, J. Mater. Res., Vol. 16, pp. 890-897).

The manufacturing procedures of the first method are complicated, which leads to an increased manufacturing cost. Only metals having a good castability can be used and consequently it has limited applications. The resultant material tends to have casting defects and deficient mechanical properties. In the second method, the process making periodic holes in thin metal plates leads to loss of materials. Moreover, even though there is no specific problem in manufacturing a sandwiched plate material having a single-layered truss, the truss cores and face sheets must be laminated and bonded repeatedly so as to manufacture a multi-layered structure, thereby producing many bonding points which results in disadvantages of bonding cost and strength.

On the other hand, in case of the third method, the formed truss has no ideal regular tetrahedron or pyramid shape and thus has an inferior mechanical strength. Similar to the second method, lamination and bonding are involved to manufacture a multi-layered structure and therefore disadvantageous with respect to bonding cost and strength.

FIG. 4 shows a light structure manufactured by the third method, which is formed by laminating wire-nets. This method is known to be able to reduce the manufacturing cost, but wires of two orientations are woven like fabrics, and therefore it cannot provide an ideal truss structure having an optimum mechanical and electrical property as in the above-described three-dimensional Octet truss 201 or three-dimensional Kagome truss 202. Accordingly, it embraces disadvantages in terms of cost and strength, due to lots of portions to be bonded.

By the way, a common fiber reinforced composite material is manufactured in the form of a thin two-dimensional layer, which is laminated when a thick material is required. Due to a de-lamination phenomenon between the layers, however, its strength tends to be decreased. Therefore, first the fiber is woven in a three-dimensional structure, and then a matrix such as resin, metal, or the like is combined with the structure. FIGS. 5*a*-5*b* are perspective views of the woven fiber in this three-dimensional fiber-reinforced composite material. Instead of fibers, a material such as a metallic wire having a high stiffness can be woven into a three-dimensional cellular light structure as shown in FIGS. 5*a*-5*b*. However, it also does not have the above-described ideal Octet or Kagome truss structure so that it has a decreased mechanical strength and anisotropic material properties. Consequently, the composite material using the three-dimensional woven-fiber comes to have an inferior mechanical properties.

DISCLOSURE OF INVENTION

The present invention has been made to solve the above problems occurring in the prior art, and it is an object of the invention to provide a three-dimensional cellular light structure, in which six orientational-wire groups are intercrossed at 60 degrees or 120 degrees angles in a three-dimensional space to thereby construct a structure similar to the ideal Octet or Kagome truss and having good mechanical properties such as strength, rigidity or the like.

Another object of the invention is to provide a method of mass-producing the three-dimensional cellular light structure in a cost-effective manner.

The three-dimensional light structure of the invention is constructed in such a manner that a continuous wire is directly woven into a three-dimensional structure, not in the manner that planar wire-nets are simply laminated and bonded. Therefore, the cellular light structure of the invention is very similar to the ideal Octet truss or Kagome truss, and thus exhibits good mechanical and electrical properties.

In order to accomplish the above objects, according to one aspect of the present invention, there is provided a three-dimensional wire-woven cellular light structure formed of six groups of orientational-continuous-wires intercrossed at 60 degrees or 120 degrees angles in a three-dimensional space. A unit cell of the cellular light structure of the invention comprises: a first regular tetrahedron member formed of a first to sixth wires, the first regular tetrahedron member being constructed in such a manner that the first wire, the second wire, and the third wire are intercrossed in a plane to form a equilateral triangle, the fourth wire is intercrossed with the intersection point of the second wire and the third wire, the fifth wire is intercrossed with the intersection point of the first wire and the second wire, and the sixth wire is intercrossed with the intersection point of the third wire and the first wire, the fourth wire, the fifth wire, and the sixth wire being intercrossed with one another at a single reference intersection point; and a second regular tetrahedron member contacted with contacting the first regular tetrahedron member at the reference intersection point and having a similar shape to the first regular tetrahedron, the second regular tetrahedron member being constructed in such a manner that the fourth wire, the fifth wire, and the sixth wire pass the reference intersection point and extend further, each of a group of wires is intercrossed with two wires selected from the extended fourth, fifth and sixth wires, the group of wires being in parallel with the first wire, the second wire, and the third wire respectively; wherein the wires are intercrossed with each other at 60 degrees or 120 degrees, and the unit cell is repeated in a three-dimensional pattern, thereby forming a truss-type structure.

Among the six groups of orientational-wires, three groups of orientational-wires forming a vertex of the first or second regular tetrahedron member may be intercrossed clockwise or counterclockwise when seen from the front of the vertex.

Preferably, the first and second regular tetrahedron members may have a similarity ratio of 1:1.

In addition, the first and second regular tetrahedron members may have a ratio of similarity in the range of 1:1 to 1:10.

The wires may be one selected from the group consisting of metal, ceramics, synthetic resin, and fiber-reinforced synthetic resin.

The intersection point of the wires preferably may be bonded by any method selected from the group consisting of application of a liquid- or spray-form adhesive, brazing, soldering, and welding.

According to another aspect of the invention, there is provided a reinforced composite material manufactured by filling with a resin, a ceramic or a metal the empty space of a three-dimensional wire-woven cellular light structure according to the invention.

According to yet another aspect of the invention, there is provided a reinforced composite material manufactured by filling with a resin, a ceramic or a metal the empty space of a smaller regular tetrahedron member among the first and second regular tetrahedron members, which constitutes a unit cell of a three-dimensional wire-woven cellular light structure of the invention.

According to another aspect of the invention, there is provided a method of fabricating a three-dimensional wire-woven cellular light structure formed of six groups of orientational-continuous-wires intercrossed with each other at 60 degrees or 120 degrees angles in a three-dimensional space. The method of the invention comprises steps of: forming an equilateral triangle by intercrossing a first wire, a second wire, and a third wire in a plane; forming a first regular tetrahedron member by intercrossing a fourth wire with the second wire and the third wire, intercrossing a fifth wire with the first wire and the second wire, intercrossing a sixth wire with the third wire and the first wire, and intercrossing the fourth wire, the fifth wire, and the sixth wire through a single reference intersection point; forming a second regular tetrahedron member contacting the first regular tetrahedron member at the reference intersection point and having a similar shape to the first regular tetrahedron by passing and extending the fourth wire, the fifth wire, and the sixth wire through the reference intersection point, and intercrossing each of a group of wires with two wires selected from the extended fourth, fifth and sixth wires, the group of wires being in parallel with the first wire, the second wire, and the third wire respectively; and repeatedly forming the first and second regular tetrahedron member to thereby form a truss-type structure.

In the method of the invention, among the six groups of orientational-wire, three groups of orientational-wires forming a vertex of the first or second regular tetrahedron member may be intercrossed clockwise or counterclockwise when seen from the front of the vertex.

In the method of the invention, preferably, the first and second regular tetrahedron members may have a similarity ratio of 1:1.

Furthermore, in the method of the invention, the first and second regular tetrahedron members may have a ratio of similarity in the range of 1:1 to 1:10.

In the method of the invention, the wires may be one material selected from the group consisting of metal, ceramics, synthetic resin, and fiber-reinforced synthetic resin.

The method of the invention may further comprise a step of bonding the intersection point of the wires, wherein the intersection points of the wires may be bonded by any method selected from the group consisting of application of a liquid- or spray-form adhesive, brazing, soldering, and welding.

According to another aspect of the invention, there is provided a method of manufacturing a reinforced composite material by filling with a resin, a ceramic or a metal the empty space of a three-dimensional wire-woven cellular light structure manufactured according to the method of the invention.

According to another aspect of the invention, there is provided a method of manufacturing a reinforced composite material by filling with a resin, a ceramic or a metal the empty space of a smaller regular tetrahedron member among the first and second regular tetrahedron members, which constitutes a unit cell of a three-dimensional wire-woven cellular light structure manufactured according to the method of the invention.

As described above, according to the invention, a three-dimensional cellular light structure, which has a similar form to the ideal Kagome or Octet truss and thus has good material properties, can be fabricated in a continuous and cost-effective manner.

In a conventional technique, each layer of a structure is first fabricated and then laminated or cast into the three-dimensional structure. Therefore, the conventional technique is disadvantageous in terms of manufacturing cost, owing to its non-continuous process. According to the invention, a three-dimensional structure of truss-type can be continuously fabricated by means of a through process in such a way as to weave continuous wires into a fabric, thereby enabling mass production and decreased costs.

BRIEF DESCRIPTION OF DRAWINGS

Further objects and advantages of the invention can be more fully understood from the following detailed description taken in conjunction with the accompanying drawings, in which:

FIG. 6 is a plan view of a wire-woven network formed of three orientational-parallel wire groups and similar to the two-dimensional Kagome truss in FIGS. 1*a*-1*b;*

FIG. 7 is a perspective view of a unit cell corresponding to the portion A in FIG. 6 when the two-dimensional structure of FIG. 6 is transformed into a three-dimensional structure similar to the three-dimensional Kagome truss in FIGS. 3*a*-3*c;*

FIG. 8 is a perspective view of a unit cell corresponding to the one of the Kagome truss in FIGS. 3*a*-3*c* where the unit cell is constructed using six orientational groups of wires;

FIG. 15 is a flow chart showing the manufacturing procedures of the three-dimensional cellular light structure according to the invention.

BEST MODE FOR CARRYING OUT THE INVENTION

The present invention will be hereafter described in detail with reference to the accompanying drawings.

Figure 1A:
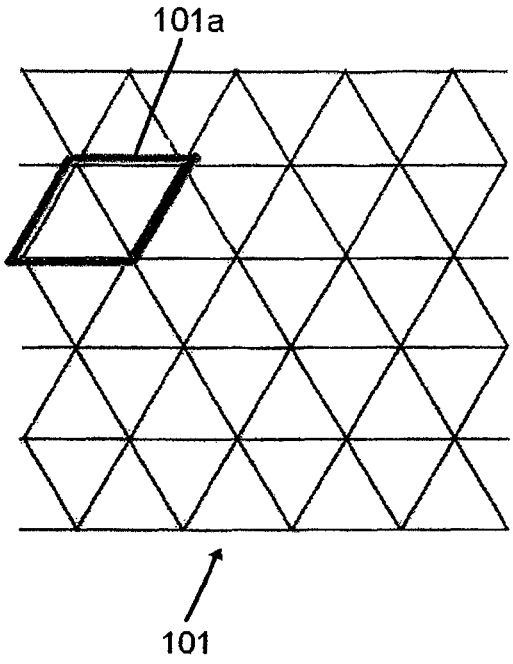
Figure 1a PRIOR ART
FIGS. 1*a*-1*b* are a two-dimensional views comparing the conventional two truss structures, i.e., the Octet truss and Kagome truss.
Figure 1B:
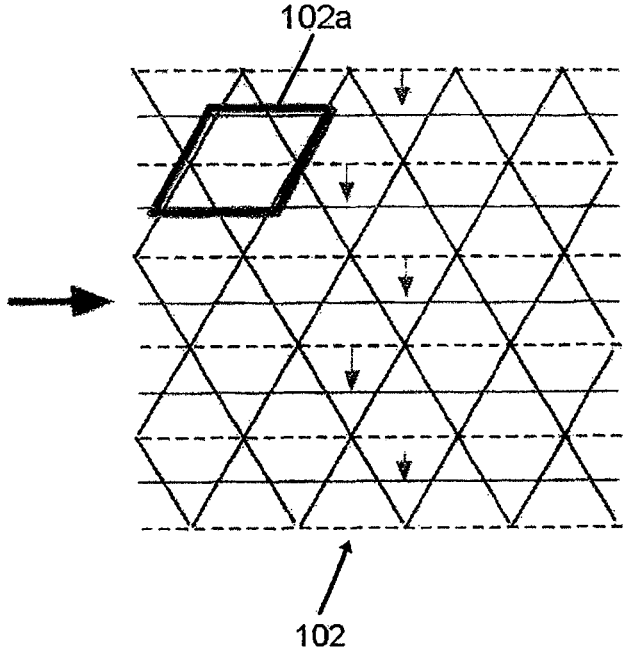
Figure 1b PRIOR ART
Figure 3A:
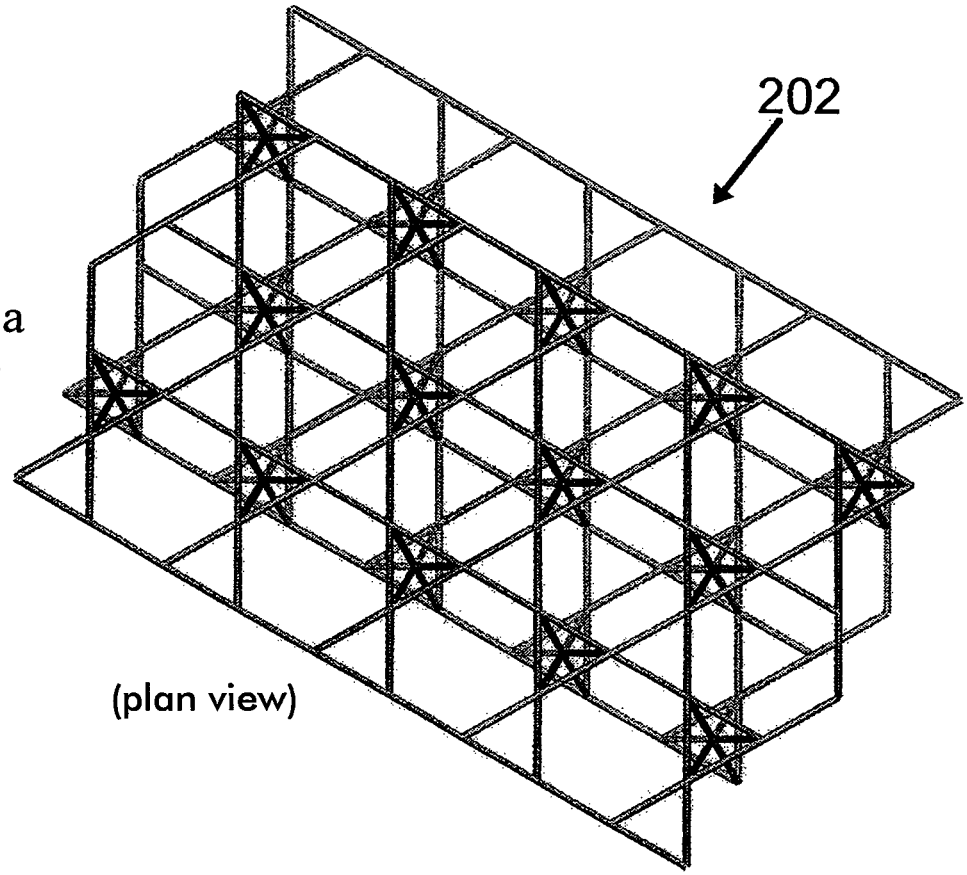
Figure 3a PRIOR ART
FIGS. 3*a*-3*c* shows a plan and side view of a single layer in the conventional Kagome truss structure and a perspective view of a unit cell thereof.
Figure 3B:
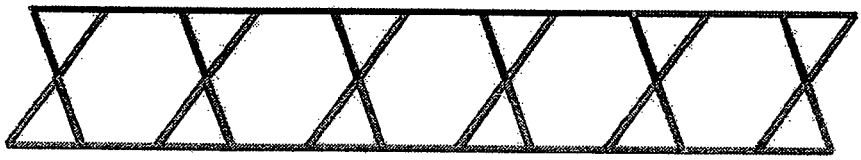
Figure 3b PRIOR ART
Figure 3C:
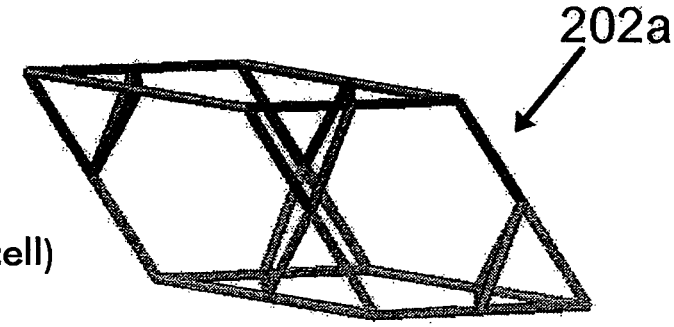
Figure 3c PRIOR ART
Figure 4:
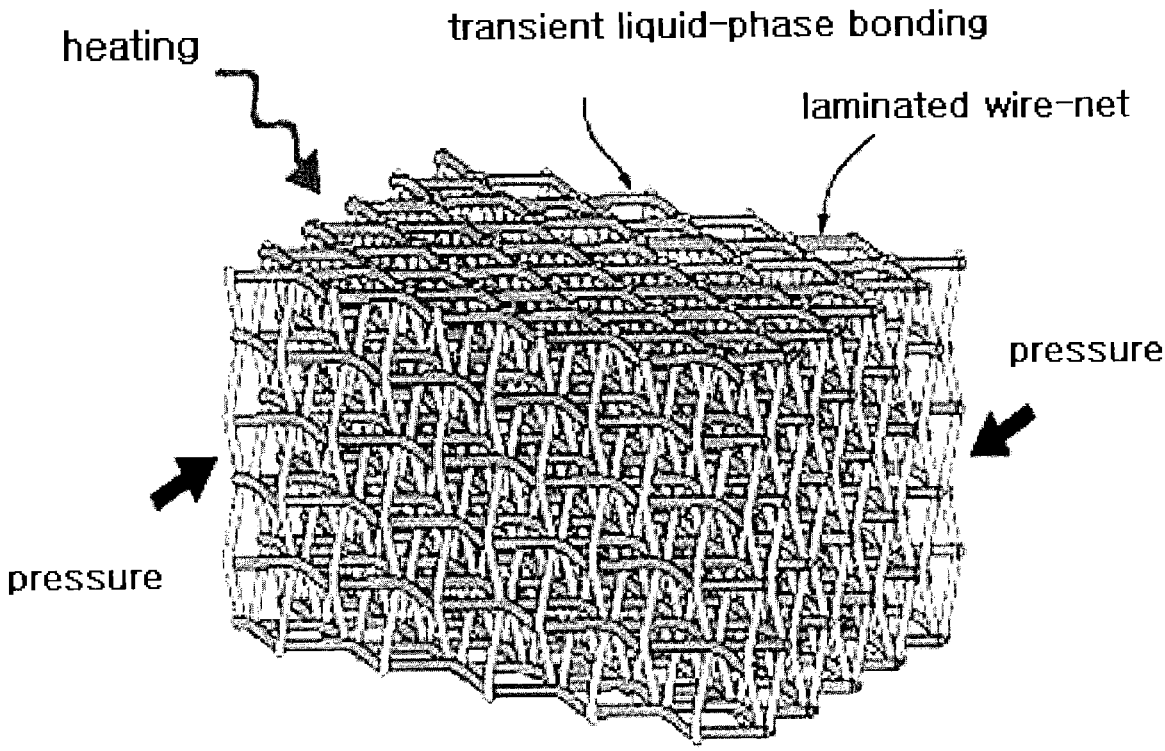
Figure 4 PRIOR ART
FIG. 4 is a perspective view of a light structure manufactured by laminating wire-nets according to the conventional technique.
Figure 5A:
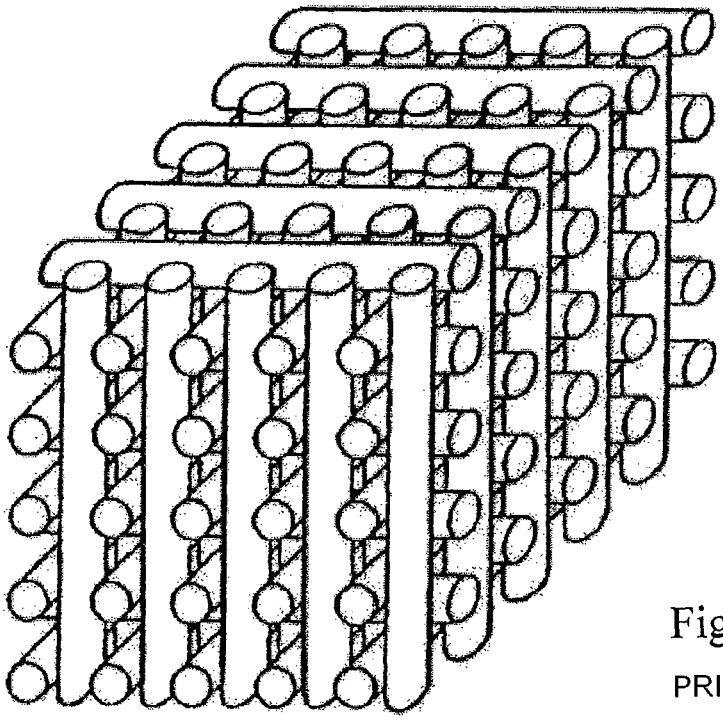
Figure 5a PRIOR ART
FIGS. 5*a*-5*b* show is a three-dimensional perspective view and detailed structure showing a fiber-reinforced composite material manufactured by weaving fibers according to the conventional technique.
Figure 5B:
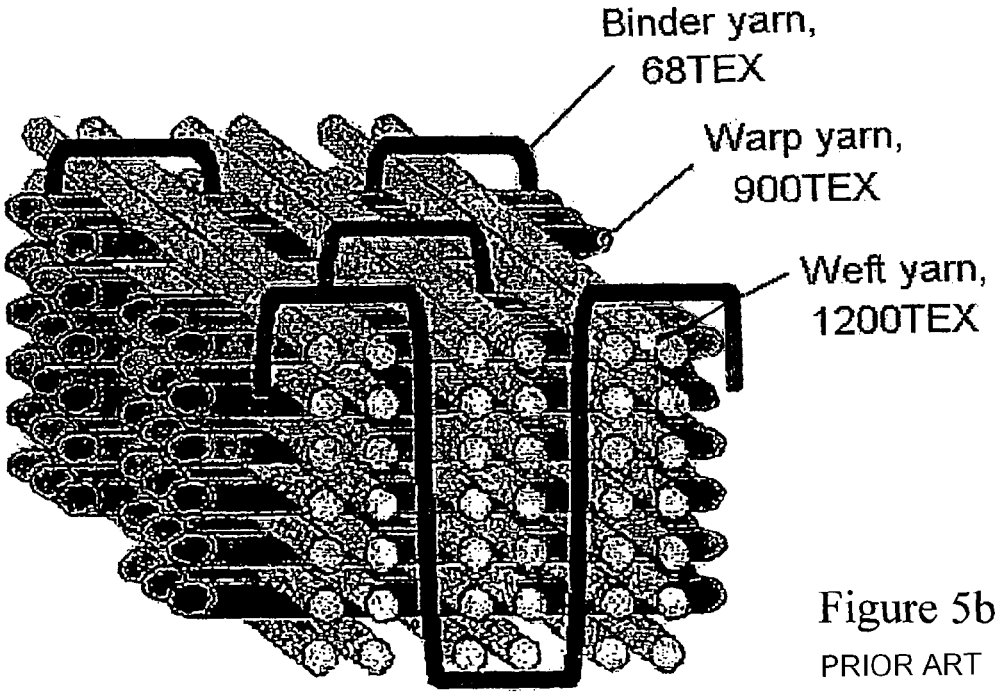
Figure 5b PRIOR ART
Figure 9:
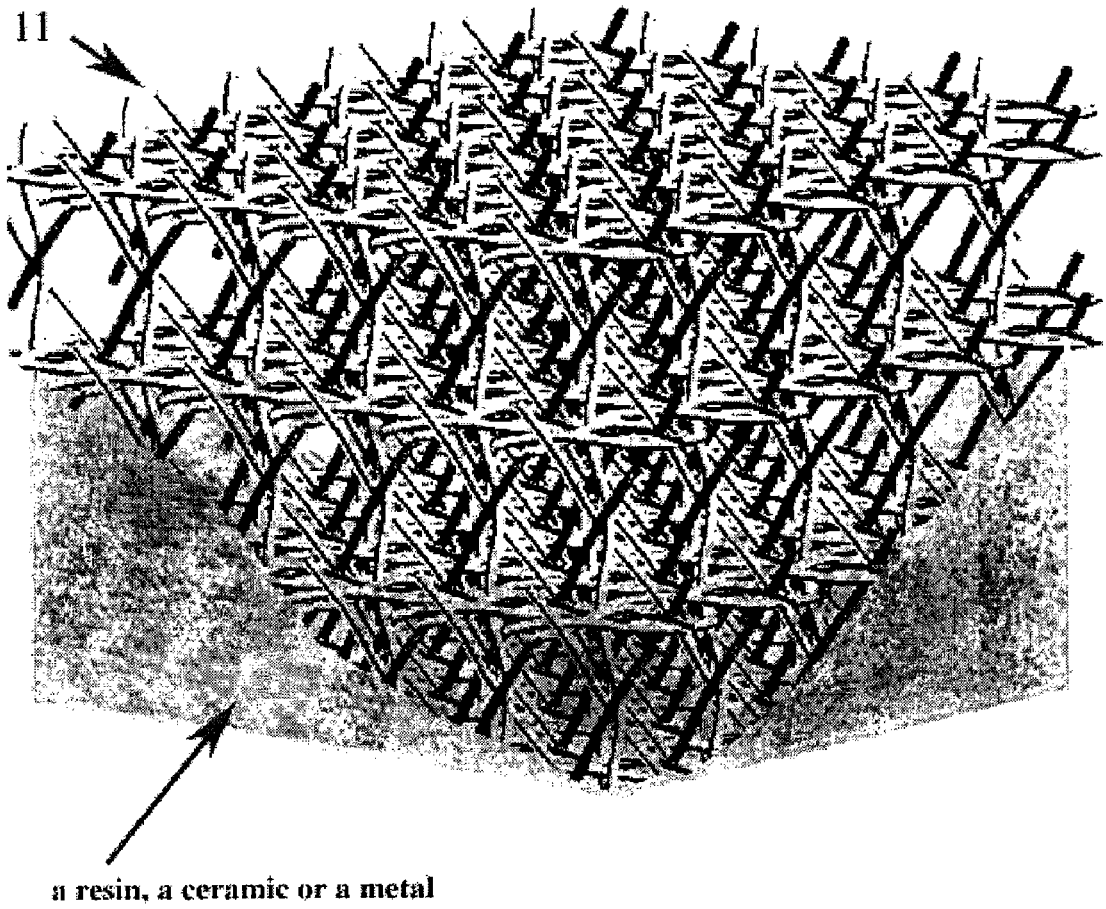
FIG. 9 is a perspective view showing a three-dimensional cellular light structure of Kagome truss type, which is manufactured using six orientational-wire groups.
Figure 10A:
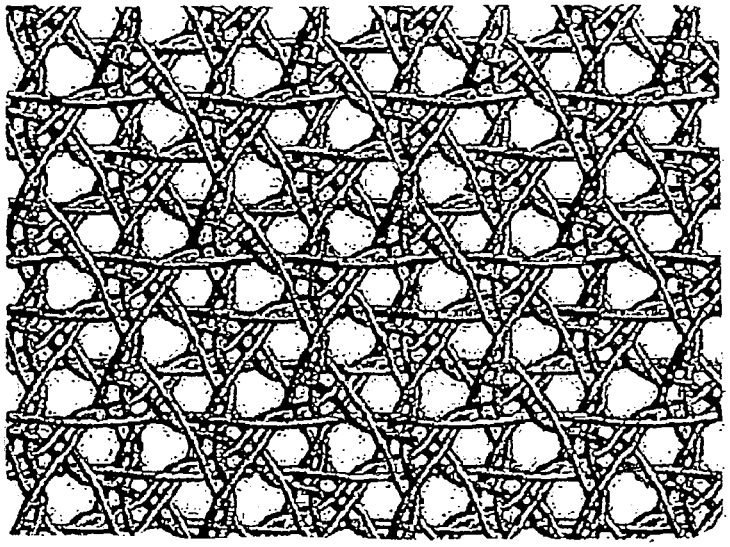
FIGS. 10*a*-10*c* are is perspective views of the three-dimensional cellular light structure of FIG. 9 as seen from different angles.
Figure 10B:
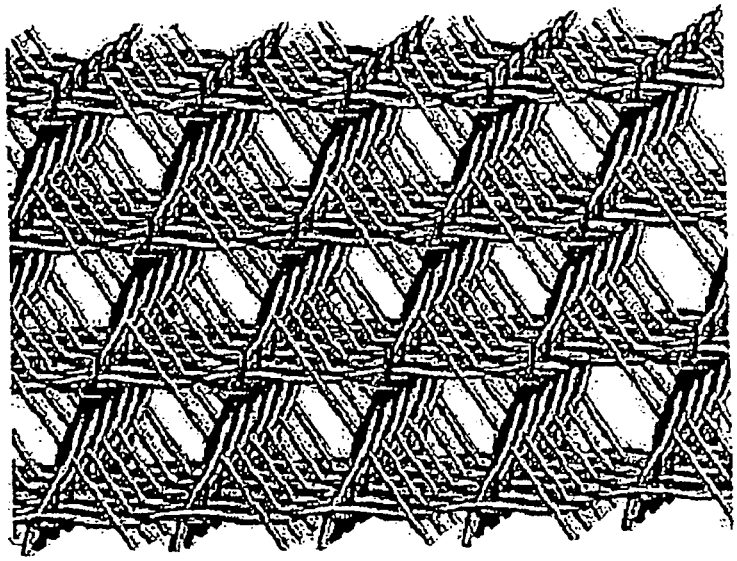
Figure 10C:
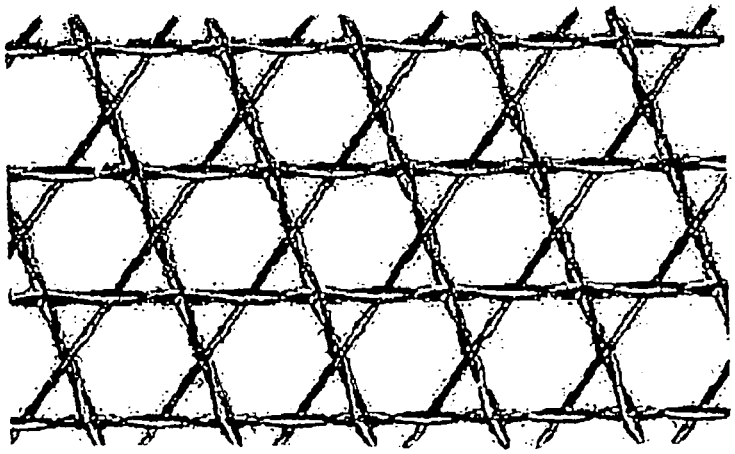
Figure 11A:
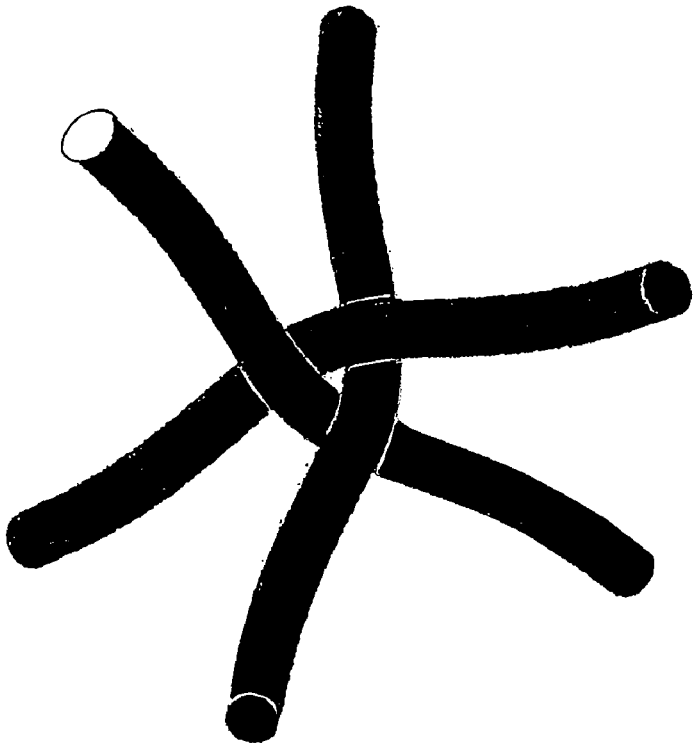
FIGS. 11*a*-11*b* are perspective views of a vertex of the regular tetrahedron formed by the three orientational-wire groups in the structure of FIG. 9 where the vertex is seen from the front thereof.
Figure 11B:
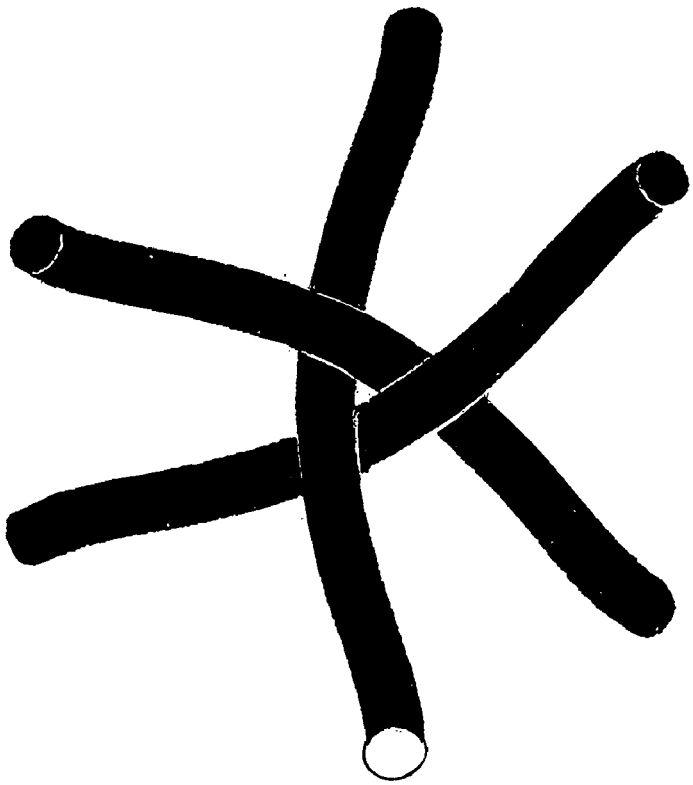
Figure 12A:
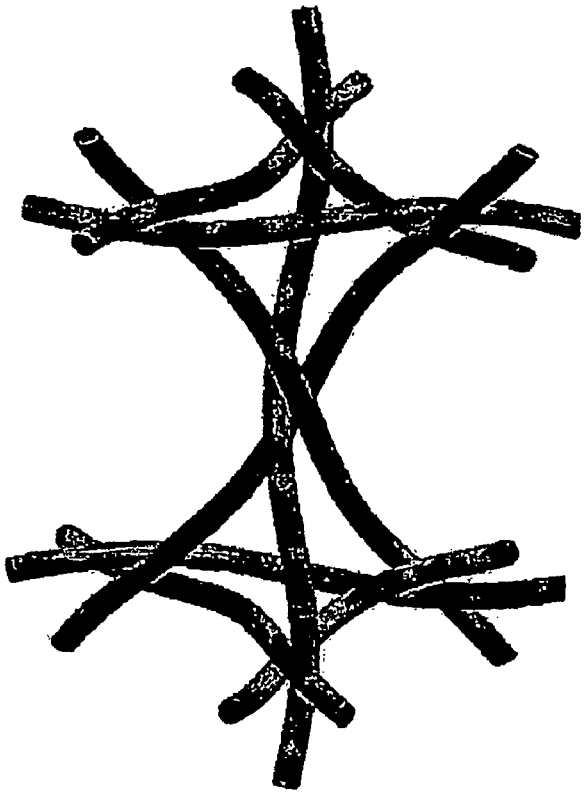
FIGS. 12*a*-12*b* are perspective views of unit cells formed by the different wire-intercrossing mode of FIGS. 11*a*-11*b;*
Figure 12B:
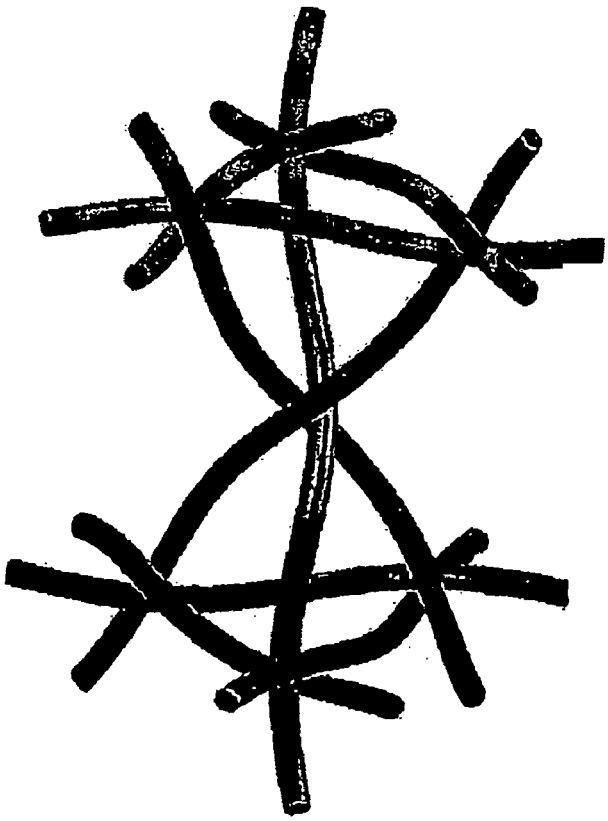
Figure 13:
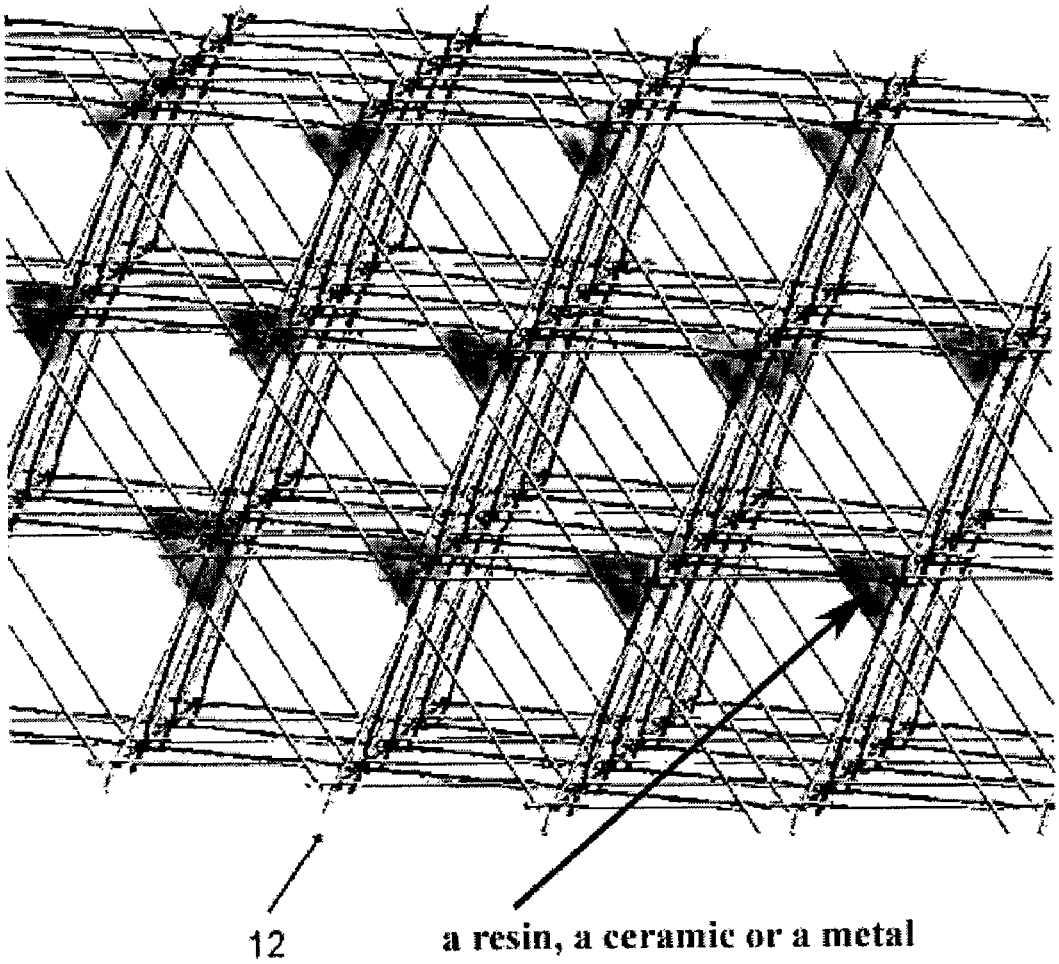
FIG. 13 is a perspective view of a three-dimensional cellular light structure of Octet truss type where the structure has a different length between the intersection points of wires.
Figure 14:
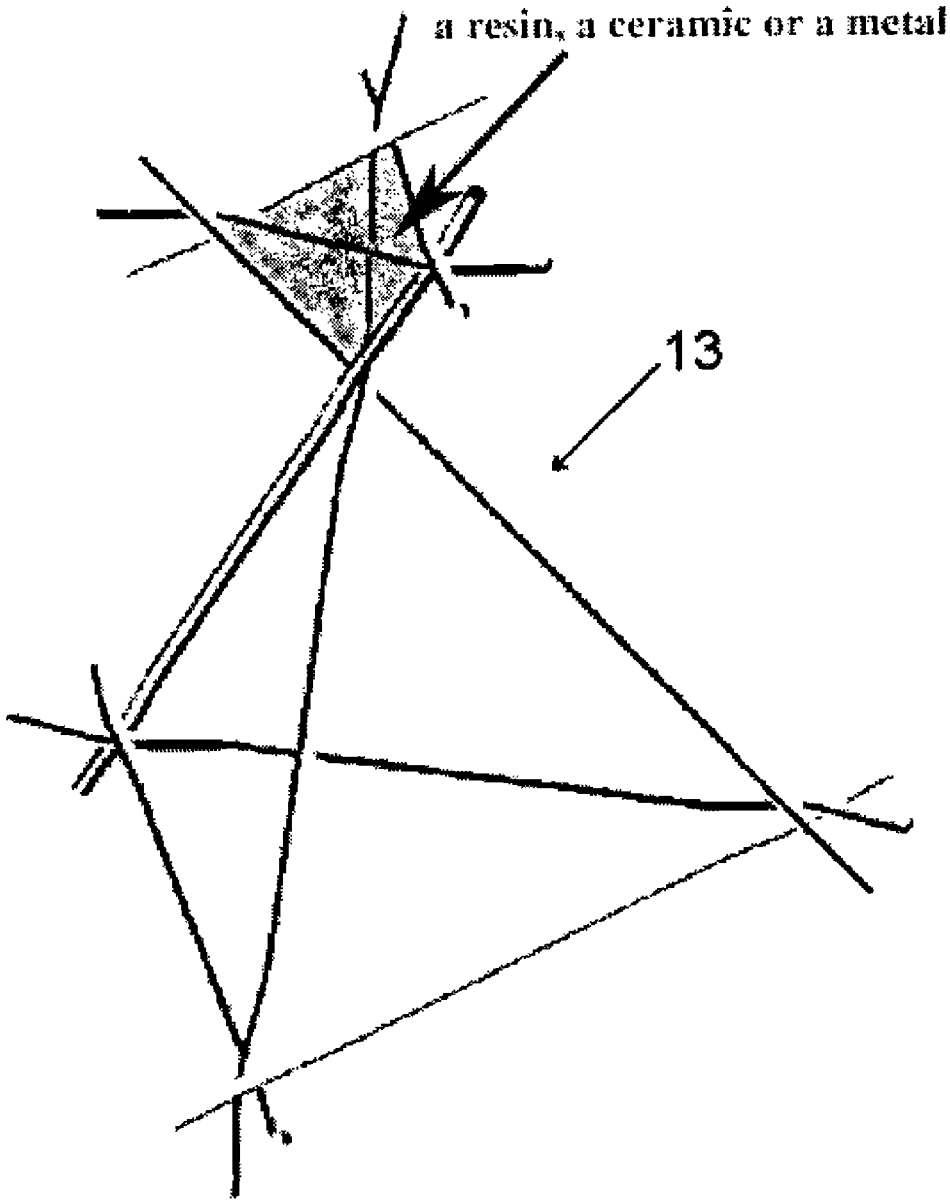
FIG. 14 is a perspective view of a unit cell in the structure of FIG. 13.

FIG. 6 is a plan view of a wire-woven network formed of three orientational-parallel wire groups and similar to the two-dimensional Kagome truss in FIGS. 1*a*-1*b* FIG. 1*b*, FIG. 7 is a perspective view of a unit cell corresponding to the portion A in FIG. 6 when the two-dimensional structure of FIG. 6 is transformed into a three-dimensional structure similar to the three-dimensional Kagome truss in FIGS. 3*a*-3*c*, FIG. 8 is a perspective view of a unit cell corresponding to the one of the Kagome truss in FIGS. 3*a*-3*c* FIG. 3*c* where the unit cell is constructed using six orientational groups of wires, FIG. 9 is a perspective view showing a three-dimensional cellular light structure of Kagome truss type, which is manufactured using six orientational-wire groups, FIGS. 10*a*-10*c* are perspective views of the three-dimensional cellular light structure of FIG. 9 as seen from different angles, FIGS. 11*a*-11*b* are perspective views of a vertex of the regular tetrahedron formed by the three orientational-wire groups in the structure of FIG. 9 where the vertex is seen from the front thereof, FIGS. 12*a*-12*b* are perspective views of unit cells formed by the different wire-intercrossing mode of FIGS. 11*a*-11*b*, FIG. 13 is a perspective view of a three-dimensional cellular light structure of Octet truss type where the structure has a different length between the intersection points of wires, FIG. 14 is a perspective view of a unit cell in the structure of FIG. 13, and FIG. 15 is a flow chart showing the manufacturing procedures of the three-dimensional cellular light structure according to the invention.

First, the construction of the three-dimensional cellular light structure according to the invention will be explained below.

FIG. 6 is a plan view of a wire-woven network formed of three orientational-wire groups 1, 2 and 3, which is similar to the two-dimensional Kagome truss in FIG. 1*b*. In the network, which is woven in three axes using the wire groups 1, 2, and 3, two lines of each intersection point are intercrossed at 60 degree or 120 degrees. Each truss element constituting the Kagome truss is substituted with a continuous wire, and thus the structure of the invention has a great similarity to an ideal Kagome truss, except that the continuous wire curves while intercrossing each intersection point thereof.

FIG. 7 is a three-dimensional view of the portion marked by A in FIG. 6. The equilateral triangles facing each other are transformed into regular tetrahedrons, and three wires, not two wires, are intercrossed with each other at 60 degrees or 120 degrees. This structure is constructed by six orientational-wire groups 4 to 9, which are disposed so as to have the same orientation angle with each other as in the three-dimensional space.

The unit cell composed of the six orientational-wire groups 4 to 9 generally comprises two regular tetrahedron members having similar shape, which are symmetrical about a common vertex and facing each other. The structure of the unit cell will be described in detail below.

Wire groups 4, 5, and 6 are intercrossed with each other in a plane so as to form an equilateral triangle. The wire 7 intercrosses the intersection point of the wire 5 and the wire 6, the wire 8 intercrosses the intersection point of the wire 4 and the wire 5, and the wire 9 intercrosses the intersection point of the wire 6 and the wire 4. Here, the wire groups 6, 9, 7 are intercrossed with each other so as to form an equilateral triangle, the wire groups 4, 8, 9 are intercrossed with each other to form an equilateral triangle, and the wire groups 5, 7, 8 are intercrossed with each other to thereby form an equilateral triangle. Consequently, the six orientation-wire groups 4 to 9 are arranged so as to form a regular tetrahedron member (a first regular tetrahedron).

Other wire groups 4', 5' and 6' are provided in such a way as to be located above the vertex (reference vertex) of the first regular tetrahedron member, which is formed by intercrossing of the wire groups 7, 8, and 9 and which is located above the plane in which the wire groups 4, 5, and 6 are intercrossed with one another. The other wire groups 4', 5', and 6', which have the same orientations as the wire groups 4, 5, and 6, are disposed such that each of them intercrosses two wires selected from the wire groups 7, 8, and 9 to thereby form an equilateral triangle. Accordingly, the wire groups 4', 5', 6', 7, 8, and 9 are disposed so as to form another regular tetrahedron member (the second regular tetrahedron). In consequence, the unit cell of the three-dimensional cellular light structure 10 is composed of the first regular tetrahedron member formed by the wire groups 4, 5, 6, 7, 8, and 9 and the second regular tetrahedron member formed by the wire groups 4', 5', 6', 7, 8, and 9. The first and second regular tetrahedron members are constructed respectively at the upper and lower side of the intersection point formed by the wire groups 7, 8, and 9 and face each other. Here, the first and second regular tetrahedron members have a similar shape. If the ratio of similarity (the ratio of length) is 1:1, the unit cell constitutes a structure similar to the Kagome truss. If the ratio of similarity is much higher than 1:1, the first regular tetrahedron member is much smaller than the second one to the extent to be considered as a single point, thereby forming a structure similar to the Octet truss.

In the case where the cellular light structure of the invention has a similar structure to the Octet truss, the similarity ratio of a smaller tetrahedron member to a larger one is preferred to be below 1:10. If the similarity ratio is higher than 1:10, the wires must be bent so as to form a small radius of curvature in order to construct the smaller regular tetrahedron member, thereby leading to difficulty in fabricating the structure. Furthermore, the edge wires constituting the larger tetrahedron member come to have excessive slenderness, which tends to result in a buckling phenomenon.

In order to form a plurality of unit cells 10 in a three-dimensional continuous pattern, the wires are disposed such that an opposing regular tetrahedron member can be constructed at each of the vertexes of a regular tetrahedron member, which is formed by the wire groups 4 to 9. Therefore, a three-dimensional cellular light truss-structure can be constructed in such a manner that the above unit-cell is repeatedly formed and combined in the three-dimensional space.

In this way, a unit cell similar to the one of the three-dimensional Kagome truss shown in FIG. 3*c* can be constructed through the above-described wire arrangement of six orientational-wires, which is shown in FIG. 8.

FIG. 9 illustrates a three-dimensional Kagome truss aggregate, which is constructed in the above-described manner using wires. It shows a three-dimensional cellular light structure 11 of truss-type, in which the unit cell in FIG. 7 or 8 is repeatedly combined.

As shown in FIGS. 10*a*-10*c*, the three-dimensional cellular light structure 11 of truss-type appears differently depending on the viewing directions. In particular, the figure at the bottom of FIGS. 10*a*-10*c* is almost similar to the two-dimensional Kagome truss, and is seen from the direction of one wire among the six orientational-wire groups. That is, the three-dimensional cellular light structure 11 of the invention appears to have the same shape and pattern when seen along the axial direction of each of six wires, which are intercrossed with each other at the same angle (60 degrees or 120 degrees).

Each intersection point, at which three wires are intercrossed, corresponds to a vertex of the regular tetrahedron members. As shown in FIGS. 11*a*-11*b*, the wires are intercrossed in two different modes when seen from the right front of the vertex. As illustrated respectively in the upper and lower figures of FIGS. 11*a*-11*b*, the three wires may be intercrossed in such a manner to be overlapped clockwise or counterclockwise. In the case where the wires are intercrossed in a clockwise-overlapped pattern, the regular tetrahedron constituting a unit cell has a concave form as shown in the upper illustration of FIGS. 12*a*-12*b* If the wires are intercrossed in a counterclockwise-overlapped pattern, the unit cell has a convex form. Nevertheless, both cases may result in a cellular light structure, which is intended in the present invention and has a similar structure to the ideal Kagome truss, or the Octet truss as described below.

Figure 2A:
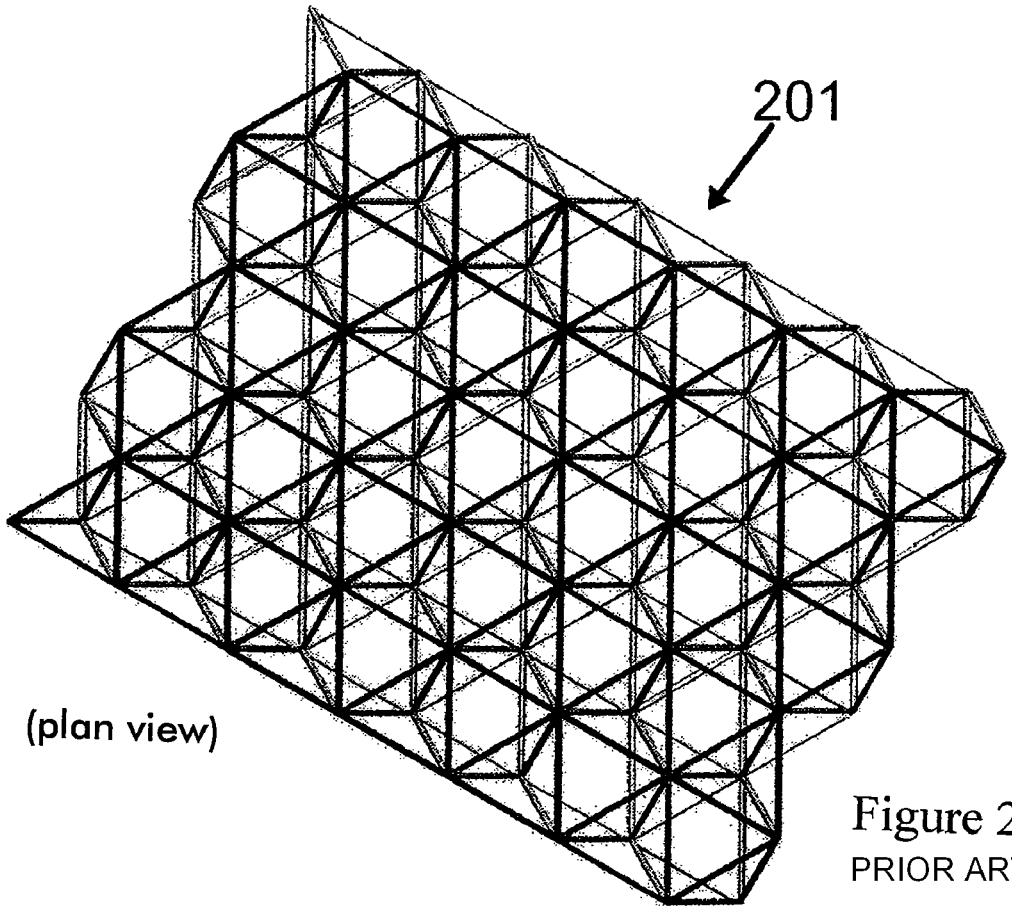
Figure 2a PRIOR ART
FIGS. 2*a*-2*c* shows a plan and side view of a single layer in the conventional Octet truss structure and a perspective view of a unit cell thereof.
Figure 2B:
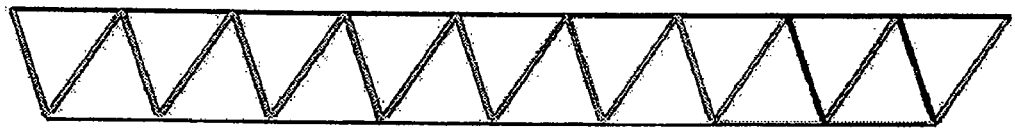
Figure 2b PRIOR ART
Figure 2C:
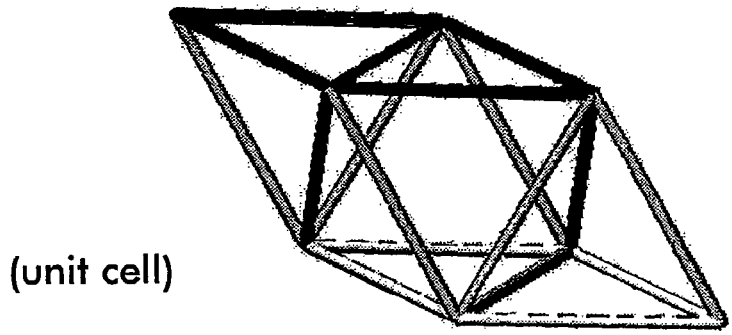
Figure 2c PRIOR ART

By the way, the cellular light structure shown in FIGS. 10*a*-10*c* has the same length of wire between all the intersection points. If the wire length of one edge of the tetrahedron member is made shorter, and that of its neighboring tetrahedron member is made relatively longer, a similar structure to the ideal Octet truss of FIGS. 2*a*-2*c* can be obtained. In this case, the two regular tetrahedron members, which constitute the unit cell of the cellular light structure, do not have the similarity ratio of 1:1.

FIG. 13 illustrates a cellular light structure 12 similar to the above-described Octet truss.

FIG. 14 is an enlarged perspective view of the unit cell of FIG. 13, where a smaller tetrahedron member and a larger tetrahedron member are faced with each other. In the case where an adhesive is applied in order to hold the wires in place, the inner space of the smaller tetrahedron member is filled with the adhesive and thus serves as a vertex of the unit cell 13 of a Octet truss.

According to the invention, a method of fabricating the three-dimensional cellular light structure will be described below.

FIG. 15 is a flow chart showing the manufacturing procedures of the three-dimensional cellular light structure according to the invention. According to the fabricating method of the invention, a basic equilateral triangle is formed by intercrossing three wires 4, 5, and 6 in a plane. Then, a basic regular tetrahedron (a first regular tetrahedron member) is constructed in such a by a wire 7 intercrossing the intersection point of the wires 5 and 6, a wire 8 intercrossing the intersection point of the wires 4 and 5, and a wire 9 intercrossing the intersection point of the wire 6 and 4, the three wires 6, 9, and 7 being intercrossed so as to form an equilateral triangle, the three wires 4, 8, and 9 being intercrossed so as to form an equilateral triangle, and the three wires 5, 7, and 8 being intercrossed so as to form an equilateral triangle. Next, above the vertex of the first tetrahedron member formed by the wires 4 to 9, another basic equilateral triangle is formed by intercrossing three wires 4', 5', and 6', each of which has the same orientation as the wires 4, 5, and 6 respectively. Thereafter, another regular tetrahedron (a second regular tetrahedron member) is constructed in by intercrossing the three wires 4', 8, and 9, the three wires 5', 7, and 8, and the three wires 6', 9, and 7 so as to form respective equilateral triangles. Accordingly, at both sides of the intersection point (vertex) formed by the three wires 7, 8, and 9, the first tetrahedron member (formed by the wires 4, 5, 6, 7, 8, and 9) and the second tetrahedron member (formed by the wires 4', 5', 6', 7, 8, and 9) are constructed to face each other and form a unit cell. In the same way as above, the wires are disposed such that an opposing tetrahedron member can be formed at each of the other vertexes of the first regular tetrahedron member formed by the six wires 4 to 9, and thus a plurality of unit cells can be repeatedly formed to thereby fabricate a three-dimensional cellular light structure of the invention. In this case, the first and second tetrahedron members have a similar shape. In the case where the similarity ratio thereof is 1:1, they form a structure similar to the Kagome truss. If the similarity ratio is much higher than 1:1, they come to make a structure similar to the Octet truss as described above.

The wire material of the three-dimensional cellular light structure of truss-type is not specifically limited, but may employ metals, ceramics, fibers, synthetic resins, fiber-reinforced synthetic resins, or the like.

In addition, the intersection points among the above wires 4, 5, 6, 4', 5', 6', 7, 8, and 9 may be firmly bonded. In this case, the bonding means is not specifically limited, but may employ a liquid- or spray-form adhesive, brazing, soldering, welding, and the like.

Furthermore, there is no limitation in the diameter of the wires and the size of the cellular light structure. For example, iron rods of tens of millimeters in diameter can be employed in order to construct a structural material for buildings, etc.

On the other hand, if wires of a few millimeters are used, the resultant cellular light structure can be used as a frame structure for reinforced composite material. For example, using as a basic frame the three-dimensional cellular light structure of the inventions, a liquid or semi-solid resin or metal may be filled into the empty space of the structure and then solidified to thereby manufacture a bulk reinforced composite material having a good rigidity and toughness. Furthermore, in the case where the three-dimensional cellular light structure of Octet type shown in FIG. 13 is used, the smaller one of the two tetrahedron members constituting the unit cell may be filled with resin or metal to manufacture a porous reinforced composite material. This reinforced composite material is isotropic or almost isotropic and thus has uniform material properties regardless of its orientation. Therefore, it can be cut into any arbitrary shapes. Also, the wires are interlocked in all directions, thereby preventing such as delamination or pull-out of wires, which can occur in conventional composite materials.

INDUSTRIAL APPLICABILITY

As described above, according to the invention, a three-dimensional cellular light structure, which has a similar form to the ideal Kagome or Octet truss and thus has good material properties, can be fabricated in a continuous and cost-effective manner.

In conventional techniques, each layer structure is first fabricated and then laminated or cast into a three-dimensional structure. Therefore, the conventional technique is disadvantageous in terms of manufacturing cost, owing to its non-continuous process. According to the invention, a three-dimensional structure of truss-type can be continuously fabricated by means of a through process in such a way as to weave continuous wires into a fabric, thereby enabling mass production and related costs.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A reinforced composite material manufactured by filling with a resin, a ceramic or a metal the empty space of a three-dimensional wire-woven truss-type cellular light structure formed of six groups of orientational-continuous-wires intercrossed with each other at angles of 60 degrees or 120 degrees in a three-dimensional space, the cellular light structure comprising a plurality of unit cells, each unit cell of the cellular light structure comprising:

a) a first regular tetrahedron member formed of first to sixth wires, the first regular tetrahedron member being constructed in such a manner that the first wire, the second wire, and the third wire are intercrossed in a plane, the fourth wire is intercrossed with the intersection point of the second wire and the third wire, the fifth wire is intercrossed with the intersection point of the first wire and the second wire, and the sixth wire is intercrossed with the intersection point of the third wire and the first wire, the fourth wire, the fifth wire, and the sixth wire being intercrossed with one another at a single reference intersection point, each side of the first regular tetrahedron member being equilateral; and b) a second regular tetrahedron member contacting the first regular tetrahedron member at the reference intersection point and having a similar shape to the first regular tetrahedron member, the second regular tetrahedron member being constructed in such a manner that the fourth wire, the fifth wire, and the sixth wire pass the reference intersection point and extend further, each of a group of three wires being intercrossed with one wire selected from the extended fourth, fifth and sixth wires and with another wire of the group of three wires so that each side of the second regular tetrahedron member is equilateral, the group of three wires being parallel to the first wire, the second wire, and the third wire respectively;

c) wherein the wires are intercrossed with each other at 60 degrees or 120 degrees, each of the wires being curved in a first direction at a first intersection with a first group of two other wires and being curved in a second direction, which is opposite to the first direction, at a second intersection with a second group of two other wires, the second intersection being adjacent to the first intersection, the unit cell being repeated to form the plurality of unit cells in a three-dimensional pattern.

2. A reinforced composite material manufactured by filling with a resin, a ceramic or a metal the empty space of a smaller regular tetrahedron member among the first and second regular tetrahedron members, which constitutes a unit cell of a three-dimensional wire-woven truss-type cellular light structure formed of six groups of orientational-continuous-wires intercrossed with each other at angles of 60 degrees or 120 degrees in a three-dimensional space, a unit cell of the cellular light structure comprising:

a) a first regular tetrahedron member formed of first to sixth wires, the first regular tetrahedron member being constructed in such a manner that the first wire, the second wire, and the third wire are intercrossed in a plane, the fourth wire is intercrossed with the intersection point of the second wire and the third wire, the fifth wire is intercrossed with the intersection point of the first wire and the second wire, and the sixth wire is intercrossed with the intersection point of the third wire and the first wire, the fourth wire, the fifth wire, and the sixth wire being intercrossed with one another at a single reference intersection point, each side of the first regular tetrahedron member being equilateral; and b) a second regular tetrahedron member contacting the first regular tetrahedron member at the reference intersection point and having a similar shape to the first regular tetrahedron member, the second regular tetrahedron member being constructed in such a manner that the fourth wire, the fifth wire, and the sixth wire pass the reference intersection point and extend further, each of a group of three wires being intercrossed with one wire selected from the extended fourth, fifth and sixth wires and with another wire of the group of three wires so that each side of the second regular tetrahedron member is equilateral, the group of three wires being parallel to the first wire, the second wire, and the third wire respectively;

c) wherein the wires are intercrossed with each other at 60 degrees or 120 degrees, and the unit cell is repeated in a three-dimensional pattern; and d) wherein the first and second regular tetrahedron members have a ratio of similarity in the range of 1:1 to 1:10.

3. A method of manufacturing a reinforced composite material by filling with a resin, a ceramic or a metal the empty space of a three-dimensional wire-woven truss-type cellular light structure formed of six groups of orientational-continuous-wires intercrossed with each other at angles of 60 degrees or 120 degrees in a three-dimensional space manufactured according to a method comprising steps of:

a) forming an equilateral triangle by intercrossing a first wire, a second wire, and a third wire in a plane;

b) forming a first regular tetrahedron member by intercrossing a fourth wire with the second wire and the third wire, intercrossing a fifth wire with the first wire and the second wire, intercrossing a sixth wire with the third wire and the first wire, and intercrossing the fourth wire, the fifth wire, and the sixth wire at a single reference intersection point, each side of the first regular tetrahedron member being equilateral;

c) forming a second regular tetrahedron member contacting the first regular tetrahedron member at the reference intersection point and having a similar shape to the first regular tetrahedron member by passing and extending the fourth wire, the fifth wire, and the sixth wire through the reference intersection point, and intercrossing each of a group of three wires with one wire selected from the extended fourth, fifth and sixth wires and with another wire of the group of three wires so that each side of the second regular tetrahedron member is equilateral, the group of three wires being parallel to the first wire, the second wire, and the third wire respectively; and d) repeatedly forming the first and second regular tetrahedron member to thereby form the cellular light structure wherein each of the wires is curved in a first direction at a first intersection with a first group of two other wires and is curved in a second direction, which is opposite to the first direction, at a second intersection with a second group of two other wires, the second intersection being adjacent to the first intersection.

4. A method of manufacturing a reinforced composite material by filling with a resin, a ceramic or a metal the empty space of a smaller regular tetrahedron member among first and second regular tetrahedron members, which constitutes a unit cell of a three-dimensional wire-woven truss-type cellular light structure, formed of six groups of orientational-continuous-wires intercrossed with each other at angles of 60 degrees or 120 degrees in a three-dimensional space, fabricated by a method comprising steps of:

a) forming an equilateral triangle by intercrossing a first wire, a second wire, and a third wire in a plane;

b) forming a first regular tetrahedron member by intercrossing a fourth wire with the second wire and the third wire, intercrossing a fifth wire with the first wire and the second wire, intercrossing a sixth wire with the third wire and the first wire, and intercrossing the fourth wire, the fifth wire, and the sixth wire at a single reference intersection point, each side of the first regular tetrahedron member being equilateral;

c) forming a second regular tetrahedron member contacting the first regular tetrahedron member at the reference intersection point and having a similar shape to the first regular tetrahedron member by passing and extending the fourth wire, the fifth wire, and the sixth wire through the reference intersection point, and intercrossing each of a group of three wires with one wire selected from the extended fourth, fifth and sixth wires and with another wire of the group of three wires so that each side of the second regular tetrahedron member is equilateral, the group of three wires being parallel to the first wire, the second wire, and the third wire respectively; and d) repeatedly forming the first and second regular tetrahedron member to thereby form a truss-type structure;

wherein the first and second regular tetrahedron members have a ratio of similarity in the range of 1:1 to 1:10.

* * * * *